US006338186B1

(12) United States Patent
Kleinmann

(10) Patent No.: US 6,338,186 B1
(45) Date of Patent: Jan. 15, 2002

(54) DEVICE FOR RETAINING AND/OR BLOCKING SHOELACES IN PARTICULAR FOR SPORT SHOES

(76) Inventor: Philippe Kleinmann, 6, rue Léon Bonnat, 75016 Paris (FR)

( * ) Notice: Subject to any disclaimer, the term of this patent is extended or adjusted under 35 U.S.C. 154(b) by 0 days.

(21) Appl. No.: 09/509,943

(22) PCT Filed: Oct. 2, 1998

(86) PCT No.: PCT/FR98/02109

§ 371 Date: May 12, 2000

§ 102(e) Date: May 12, 2000

(87) PCT Pub. No.: WO99/22616

PCT Pub. Date: May 14, 1999

(30) Foreign Application Priority Data

Oct. 31, 1997 (FR) ..... 97 13710

(51) Int. Cl.[7] ..... A44B 21/00; A43B 11/00; F16G 11/04

(52) U.S. Cl. ..... 24/712.2; 24/712.1; 24/712.3; 24/712.6

(58) Field of Search ..... 24/712.2, 712.3, 24/712.1, 712.6, 713.6, 714.6, 715.1, 715.6, 115 H; 36/50.1

(56) References Cited

U.S. PATENT DOCUMENTS

| | | | | | |
|---|---|---|---|---|---|
| ,948,460 | A | * | 2/1910 | Partridge | 24/712.2 |
| 1,371,637 | A | | 3/1921 | Meredith | |
| 3,138,839 | A | | 6/1964 | Mathes | |
| 3,176,362 | A | | 4/1965 | Tames | |
| 3,321,815 | A | * | 5/1967 | Herdman | 24/712.2 |
| 3,473,198 | A | | 10/1969 | Meier | |
| 4,200,998 | A | * | 5/1980 | Adams | 24/712.2 |
| 4,261,081 | A | | 4/1981 | Lott | |
| 4,485,529 | A | * | 12/1984 | Blum | 24/712.3 |
| 4,553,293 | A | | 11/1985 | Blum | |
| 4,715,094 | A | | 12/1987 | Herdman | |
| 4,949,437 | A | | 8/1990 | Anderson | |
| 5,022,127 | A | * | 6/1991 | Ang | 24/712.2 |
| 5,158,428 | A | | 10/1992 | Gessner et al. | |
| 5,170,573 | A | * | 12/1992 | Clinch | 24/712.3 |
| 5,353,483 | A | | 10/1994 | Louviere | |
| 5,372,510 | A | * | 12/1994 | Stanfield | 24/712.2 |

FOREIGN PATENT DOCUMENTS

| | | | | |
|---|---|---|---|---|
| CH | 0271364 | * | 1/1951 | 24/712.6 |
| DE | 0626573 | * | 2/1936 | 24/712.6 |
| EP | 122139 | | 10/1984 | |
| EP | 337044 | | 10/1989 | |
| FR | 0744906 | * | 4/1933 | 24/712.3 |
| FR | 776483 | | 1/1935 | |
| FR | 1286791 | * | 1/1962 | 24/712.1 |
| GB | 0014569 | * | 11/1908 | 24/712.3 |
| GB | 0135431 | * | 11/1919 | 24/712.6 |
| GB | 0725536 | * | 3/1955 | 24/712.3 |

* cited by examiner

*Primary Examiner*—Victor N. Sakran
(74) *Attorney, Agent, or Firm*—Rothwell, Figg, Ernst & Manbeck

(57) ABSTRACT

The invention relates to a device for retaining and/or blocking shoelaces, for sport shoes in particular.

The device is in the shape of a tube portion (10), with two parts (11, 12) articulated about a hinge (13), that can be locked in the closed position and unlocked to allow for the insertion or removal of the shoelace in the shape of a bundle.

The device is fastened by at least one fastening means to a part integral with the shoe, for instance to a shoelace passing through at least two holes (15, 16, 17, 18) formed in at least one (12) of the two parts of the tube.

15 Claims, 3 Drawing Sheets

DEVICE FOR RETAINING AND/OR BLOCKING SHOELACES IN PARTICULAR FOR SPORT SHOES

BACKGROUND OF THE INVENTION

1. Field of the Invention

This invention relates to a device for retaining and/or blocking shoelaces, in particular for sport shoes.

2. Description of the Related Art

It is well known, all the more so by sports people, that the most comfortable shoes, the most performing as well as the most becoming are lace-up shoes. But it is equally well known that shoelaces are bothersome in many ways.

Among the drawbacks of lace use, the knot can come undone, which may mean having to retie it in a place or an uncomfortable position, since an untied knot can lead to an accident, a fall in particular, because the athlete trips over it or the lace gets caught in a derailleur, that of a mountain bike in particular.

A double knot may prevent this, yet it is not a foolproof solution and besides, it then often becomes quite difficult to untie the double knot.

Another drawback of using shoelaces is that, if the lace hangs loose on the ground, it gets dirty and can become wet or muddy, which weakens it and may dirty the bottom of the pants and socks.

Very short laces would prevent these drawbacks, but they are harder to tie.

This is why many devices have been considered, in particular elastic clamps attached to the lace, near its extremity or elsewhere on it Nonetheless, to this day no really suitable solution, from a practical as well as esthetical and economical standpoint, was implemented.

SUMMARY OF THE INVENTION

This invention relates to a new device for retaining and/or blocking shoelaces, in particular for sport shoes, said device being very easy to use, reliable, and little expensive since the same model can be adapted to many different types of uses, shoes and sports, as the user sees fit.

The device for retaining ind/or blocking shoelaces according to this invention is characterized in that it is in the shape of a tube portion, with two parts articulated about a hinge that constitutes one generatrix of the tube, parallel to its axis, and that it can be locked in closed position and can also be unlocked to allow for the insertion or removal of the shoelace in the form of a bundle, one at least of said two parts of the tube portion being equipped with fastening means to art integral part of the shoe, advantageously comprising at least two holes for the insertion of the lace to be blocked and its fastening to it, and the diameter of the opening of the tube in its locked position corresponding essentially to the lace bundle to be secured.

It will be practical and advantageous to design the diameter of the tube opening (in the locked position) so that it corresponds essentially to the diameter of a lace bundle of four to eight strands of lace. Thus it will be possible to enclose the lace in the device, said lace being already tied for instance, by enfolding the two loops and the two loose extremities of the lace, or else, if the lace is not tied, the whole of the loose extremities gathered in a bundle of reduced length which will be suitably maintained on the top of the shoe, near its base if this is where the device was set, or else upward, near the ankle for instance, if the device was placed higher on the lace, where the hole can then be hidden under a sock turnover.

The invention and its implementation, as well as some variations in design and use will be seen more clearly with the aid of the following description, which makes reference to the attached drawings.

In these drawings were represented two types of implementation or embodiments of the device according to this invention and one utilization mode, although said device is not limited to them, as will easily be deduced from the following description.

DETAILED DESCRIPTION OF THE PREFERRED EMBODIMENTS

The following description relates first to the implementation and utilization mode described in FIGS. 1 to 6.

Figure 4:
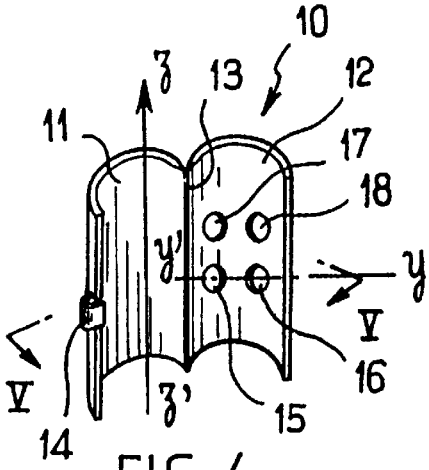
FIG. 4 shows an enlarged view in perspective of the device shown in FIG. 1, in an open position.
Figure 5:
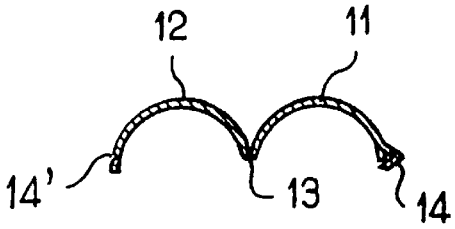
FIG. 5 shows a median cross-section, essentially along the plane V—V of FIG. 4.
Figure 6:
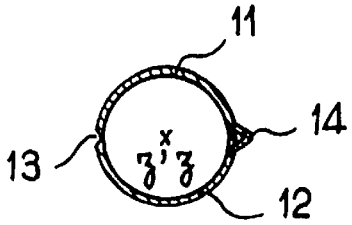
FIG. 6 shows a median cross-section of the device of this invention in the closed, locked position.

First, referring to FIG. 4, the device is shown as a whole in 10, comprising essentially two parts 11, 12, joined by a hinge 13. As seen in the figures, the device according to this invention is in the shape of a tube portion, that in the illustrated example has a circular section and is articulated in two parts about the hinge 13 that forms a generatrix of the tube parallel to its axis referenced in z'z in FIG. 4. This hinge may be a standard articulation hinge or else simply be constituted by a generatrix weakened in this part of the tube wall. Both parts 11, 12 of the tube portion are essentially symmetrical with regard to their junction plane in the closed position of the device (see FIG. 6). To insure the locking of the device in its closed position, the part 11 has a locking mechanism 14 that comes to lock itself in a corresponding holding catch 14' designed opposite on the other part.

In this illustrated example of implementation, four holes referenced as 15, 16, 17, 18 were formed in the part 12. These holes are designed in pairs, 15, 16 and 17, 18 respectively, each pair of holes being located in a plane essentially perpendicular to the tube axis. Thus, in FIG. 4, the holes 15, 16 are shown located on a line y'y orthogonal to the axis z'z. Of course, the aperture of the holes 15, 16, 17, 18 is designed so as to allow an easy insertion of the lace, and said holes can be circular or oval, for instance.

Figure 1:
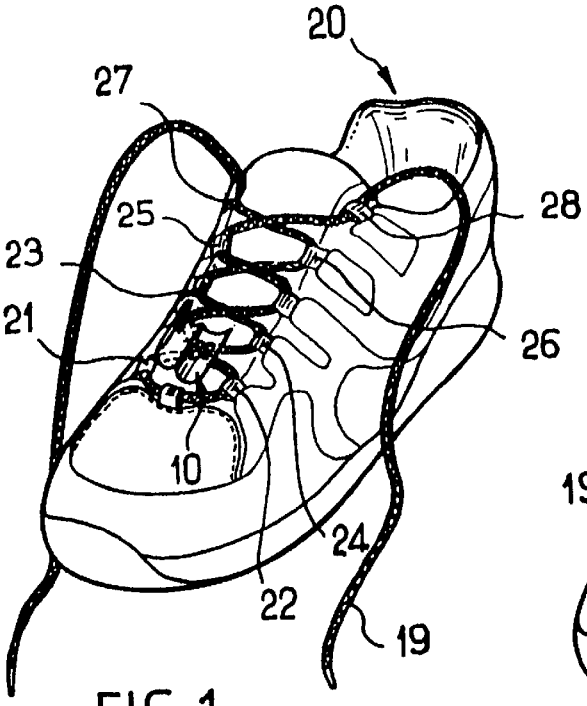
FIG. 1 shows a top view of a device according to the invention, set on a sport shoe of the jogging or sneaker type, with crossed lacing, said device being shown in its open position, with the laces undone.

As can be easily understood by looking more particularly at FIG. 1, the positioning of the two pairs of holes 15, 16; 17, 18, near one another, and by pairs above one another, allows for an easy setting of the device at the point where the lace 19 crosses over itself, whatever its level on the shoe 20. In the illustrated example, the device was placed toward the base of the shoe, between the first tier of eyelets 21, 22, and their second tier 23, 24. More precisely, at least one first lace strand is introduced through the openings 16 and 17 or 15 and 18, although it is also possible to insert the second strand in the corresponding complementary openings 15 and 18 or 16 and 17; the latter case, though, allows for less mobility of the device on the shoe. Yet the device could obviously, be placed as well between the pairs of eyelets 23, 24 and 25, 26, or else between the pairs 25, 26 and 27, 28.

Figure 2:
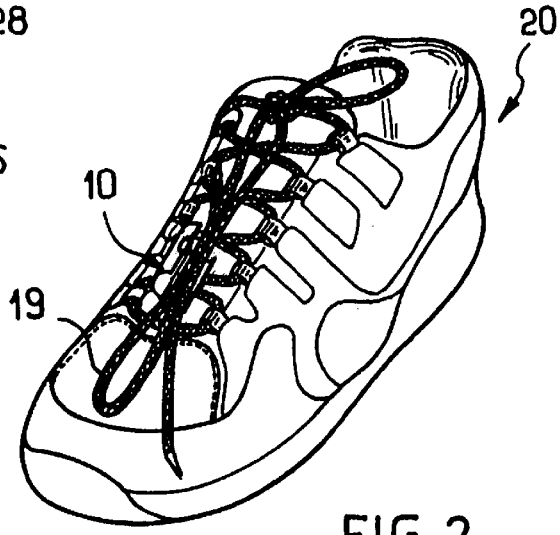
FIG. 2 shows the same shoe as FIG. 1, the device of the invention being represented half closed on the knotted laces that will enclose a loop and a low extremity of said lace.
Figure 3:
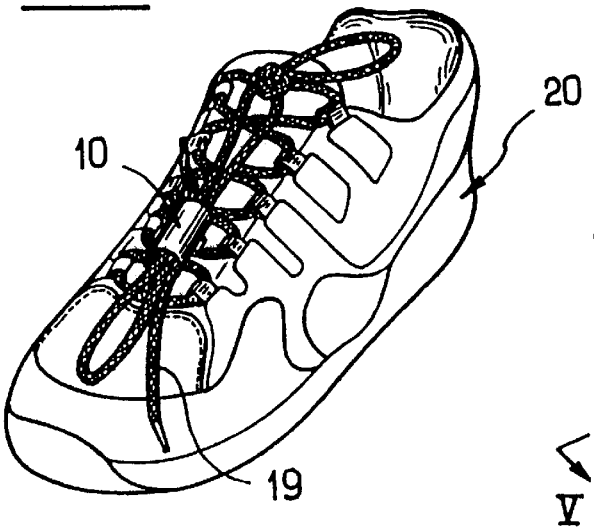
FIG. 3 shows the same device locked onto the lace.

It also appears clearly that if the lacing is not of the crossed type but a straight one, i.e. if the lace strands appear on the shoe as though going from the eyelet 21 to the eyelet 22, from the eyelet 23 to the eyelet 24, from the eyelet 25 to the eyelet 26, etc., the device can be placed on any of these paths, by inserting the lace through the holes of the pair 15, 16 or of the pair 17, 18, at any chosen level, for instance the eyelet tier 23, 24. In FIGS. 2 and 3, was shown the case when the user had tied the shoelaces in the usual way, after which he gathered in a bundle a loop and an extremity of the lace and then locked the device on the bundle thus formed by the three strands. Clearly, the user could as well have enclosed the two loops and/or the two extremities of the lace, had he so wished. Whatever the case may be, he can be sure that the lace thus blocked will not get untied and hang loose on the ground.

So that the device be effective while also being esthetically pleasing, the tube length will preferably not be too short or too long. The tube portion will advantageously be, along the axis z'z, a few cm. long, the preferable length being comprised between 2 and 4 cm. Such a length will usually insure a good blocking of the lace bundle. Nonetheless, other dimensions could be adopted for specific applications, shorter, for instance, of about 1 cm. or even less.

Figure 4A:
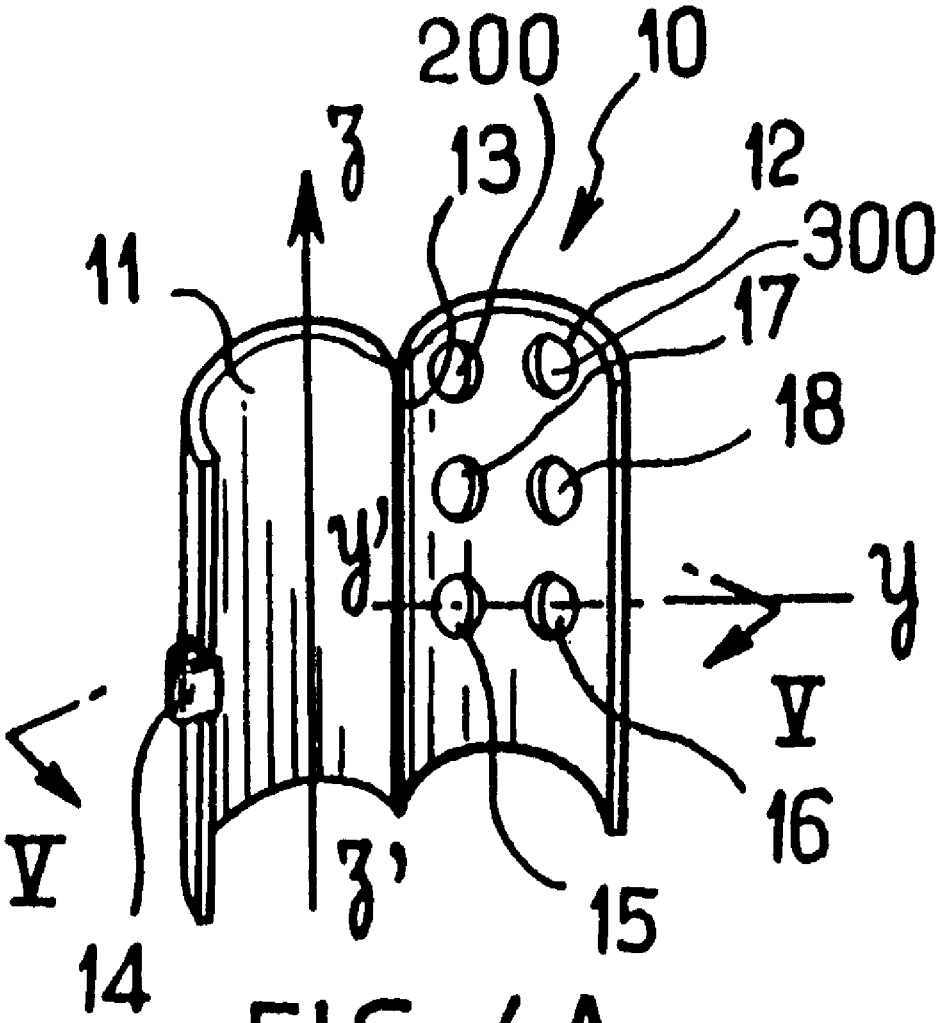
FIG. 4A shows an enlarged view in perspective of an alternative embodiment of the device shown in FIG. 1, in an open position.
Figure 7:
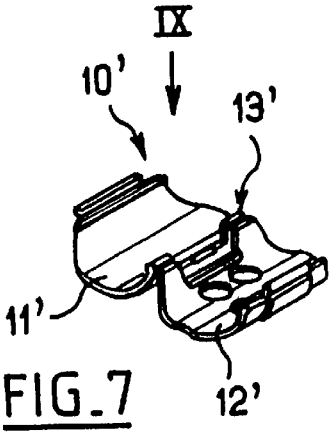
FIG. 7 shows in perspective and in the open position another possible implementation of a device according to this invention.
Figure 8:
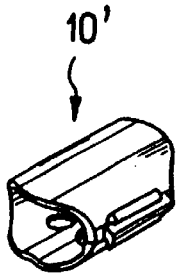
FIG. 8 shows in perspective the same device in the closed position.

To further improve the flexibility of use, more than two pairs of holes could be provided, such as three pairs of holes 15, 16, 17, 18, 200, and 300 as shown in FIG. 4A, for example. Likewise, the holes may be provided not only on one of the two parts of the device but on both parts. In this case, it is possible to use the device in one direction or its opposite. In particular, if the tube portion is cast in plastic, according to a known technique of bi-material casting the device can easily be implemented in two colors, one for the part 11, the other for the part 12, and the user will be able to display one or the other part of the device, as he wishes. Of course, the tube portions may be decorated, carry whatever appropriate trademark, and even display, embedded or not in the material, any decorative element such as a little figurine. If the design used was molded by plastic casting, the hinge 13 will advantageously be a simple film-hinge, there again according to well-known manufacturing techniques.

In the illustrated embodiment, the device was shown fastened to the lower part of the shoe. Since the device is simply set on the lace at any desired level, it may as well be placed at ankle level, in which case it can allow for the blocking of the lace bundle without having to tie the lace, if what is desired is a better flexibility of movement at the ankle level. In this case, the whole bundle of lace can be hidden under a sock turnover. This allows to wear shoelaces without having to insert the lace in the shoe or having to bother with loops hanging from the shoe, with all the subsequent drawbacks.

Clearly, although the device illustrated here was shown with a circular section, it could have any other section type, polygonal in particular, or else square or ovalized for instance, in which case "diameter" means the diameter of a circle that would present the same opening surface as that of the device.

According to a second embodiment as illustrated in FIGS. 8 to 11, the device is essentially shaped as an ovalized tube. In these figures, so as to simplify the description and avoid reiterations, elements similar to those of the first embodiment were referenced in the second one with the same numbers indexed prime.

Thus can be seen a device referenced as a whole in 10' comprising essentially two parts 11' and 12' joined by a hinge 13'. Said device also comprises a locking mechanism 30, more visible in FIGS. 9 to 11, which in the device closed position comes to lock itself into an aperture 31 under a tongue 32 protruding slightly on the outside of a section of the device. In the part 11' were designed, as in the first embodiment, four holes 15', 16', 17', 18' for the fastening 30 of the device to the shoe through the insertion in at least some of said holes of some of the lace, as described for the first embodiment.

Compared to the first embodiment, the essential differences are the following.

Figure 11:
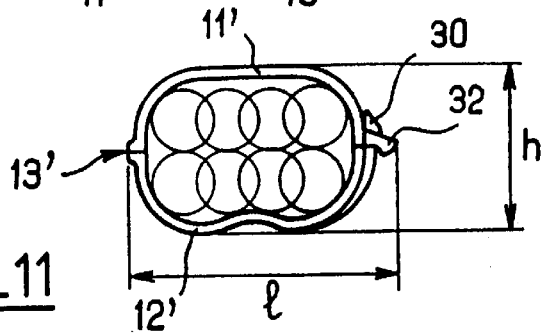
FIG. 11 shows, on the same scale as FIGS. 9 and 10, the device in its closed position, in which were represented eight circles illustrating the bulk of eight non compressed strands of laces that can be firmly maintained inside the device.

First, as can be clearly seen in FIG. 11, the general section of the device is ovalized and flattened rather than circular and rounded.

Figure 10:
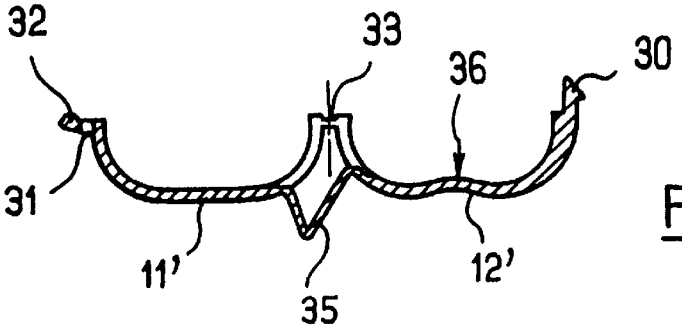
FIG. 10 is a cross-section along the median plane X—X of FIG. 9.
Figure 9:
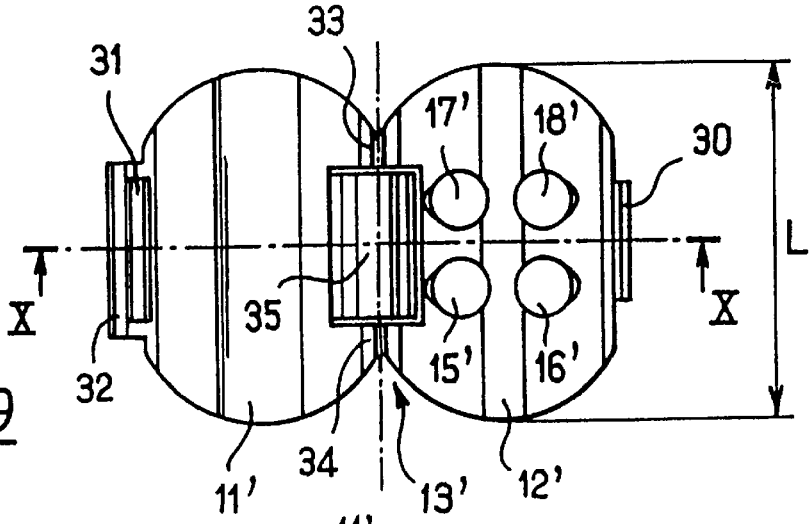
FIG. 9 is an enlarged view of said device, set flat along the direction of the arrow IX of FIG. 7.

Moreover, the hinge 13' is, from a known type allowing for an elastically assisted opening and closing, the articulation of said hinge 13' taking place in the illustrated embodiment around two articulation lines 33, 34, connecting the two parts 11', 12' of the device, while an elastic, distortable tongue 35 insures a frank opening of the device, as illustrated in FIG. 10, and also assists the closing, the presence of the tongue somehow insuring that the device be either open or closed. The elastic hinge mechanism is not a part of this invention inasmuch as it belongs to the public domain such as described in particular in the Patent France 1 595 023 or 2 007 294 that can be consulted as reference material.

FIG. 11 shows that the device will allow for the enfolding of eight strands of lace suitably compressed. In one embodiment, if the device is designed with an overall height h of about 12 mm, and an overall width of about 18.5 mm, it will be possible to suitably, enclose eight laces with a non compressed diameter of 4.5 mm. For such a sizing, the overall length of the tube L will be for instance of about 25 mm. It can also be noted that for better use and esthetic qualities, both ends of the "tube portion" formed by the device in its closed position have rounded edges, as appears more clearly in FIGS. 8 to 10 in particular.

Still referring more specifically to FIGS. 10 and 11, the part 12, in which are designed the holes 15' to 18' for the insertion of the laces, is shown slightly curved inward near its middle (at the level of the arrow 36 of FIG. 10) instead of flat, which will facilitate further the insertion and secure holding of the laces in the corresponding pairs of holes 15'–16', 17'–18'. Although the use of this device was described in reference to shoes, which will be its most practical use, it is clear that said device is also applicable to other objects such as boots, corsets, jackets, i.e. in general to any clothing item with eyelets and a tightening lace.

Moreover, the device, although advantageously fastened by simple insertion on a strand of lace in the most suitable place, may comprise other fastening means to an integral part of the object such as a shoe, said fastening 30 means being possibly a ring, a collar, a strap or any other element that will fasten itself to the device through the aforementioned holes or else, for instance, by gluing said fastening means itself fixed to the object, as either a permanent or a removable fixture.

I claim:

1. Device for retaining the extremity and untied parts of shoelaces, in particular for sport shoes, having a shape of a tube portion with an opening diameter with two parts articulated about a hinge forming a generatrix of the tube parallel to its axis, that can be locked in the closed position and unlocked to allow for the insertion or removal of the lace in the form of a bundle having a diameter corresponding to the number of strands of lace that form the bundle, one at least of said two parts of the tube portion having at least one fastening means to an integral lower part of the shoe for the positioning of the tube on the shoe and the opening diameter of the tube in its locked position corresponding essentially to the diameter of the lace bundle to be retained.

2. Device according to claim 1, wherein the fastening means comprises at least two holes for the insertion of the shoelace to be blocked and its fastening onto it.

3. Device according to claim 2, wherein the holes are designed pairs in a plane essentially perpendicular to the tube axis.

4. Device according to claim 3, comprising at least two pairs of holes.

5. Device according to claim 4, comprising at least three pairs of holes.

6. Device according to claim 5 wherein the two parts of the tube portion are essentially symmetrical vis-à-vis their junction plane in the closed position of the device.

7. Device according to claim 2, wherein the opening diameter of the tube corresponds essentially to the diameter of a bundle of four to eight strands of lace.

8. Device according to claim 1, wherein the opening diameter of the tube corresponds essentially to the diameter of a bundle of four to eight strands of lace.

9. Device according to claim 1, wherein the two parts of the tube portion are dissymmetrical vis-à-vis their junction plane in the closed position of device.

10. Device according to claim 1 being made in one piece in two parts, obtained from plastic casting, the junction part being of the type film-hinge, one of the two parts being provided with a locking mechanism that comes to lock itself in a corresponding holding catch designed in the corresponding opposite location on the other part.

11. Device according to claim 10, wherein the hinge opening and closing is of the elastically-assisted type.

12. Device according to claim 1, wherein the hinge is essentially formed by a weakened generatrix of said tube.

13. Device according to claim 12, wherein the inner section of the portion of tube is essentially circular.

14. Device according to claim 13, wherein the tube portion is a few centimeters long.

15. Device according to claim 12, wherein the inner section of the portion of tube is essentially ovalized.

* * * * *